United States Patent [19]

Harris

[11] Patent Number: 4,744,014

[45] Date of Patent: May 10, 1988

[54] LOW VOLTAGE LIGHTING SYSTEM

[75] Inventor: Edward H. Harris, Henderson, Nev.

[73] Assignee: Creations by Harris, Inc., Henderson, Nev.

[21] Appl. No.: 613

[22] Filed: Jan. 5, 1987

[51] Int. Cl.[4] ..... F21S 1/02

[52] U.S. Cl. ..... 362/145; 362/153

[58] Field of Search ..... 362/145, 234, 235, 237, 362/806, 267, 153, 146

[56] References Cited

U.S. PATENT DOCUMENTS

| | | | |
|---|---|---|---|
| 312,269 | 2/1885 | Higley | 362/153 |
| 1,853,321 | 4/1932 | Rogers | 362/153 |
| 2,093,442 | 9/1937 | Nystuen | 362/145 |
| 2,162,302 | 6/1939 | Greene | 362/145 |
| 4,394,714 | 7/1983 | Rote | 362/146 |
| 4,612,606 | 4/1986 | Roberts | 362/146 |
| 4,625,266 | 11/1986 | Winter | 362/145 |

*Primary Examiner*—E. Rollins Cross

*Attorney, Agent, or Firm*—John E. Benoit

[57] ABSTRACT

A low voltage lighting system is provided which comprises at least one stepping stone, and, preferably, a series of stepping stones, with each stepping stone having at least one recessed channel in the upper face thereof, and a light source removably inserted within the recessed channel. The light source comprises a flexible, substantially transparent tube and low voltage lights within the tube. Means are disclosed for connecting the light source to a power source in a selective or predetermined manner.

15 Claims, 4 Drawing Sheets

LOW VOLTAGE LIGHTING SYSTEM

The present invention relates broadly to low voltage lighting systems and more particularly to lighting systems used in stepping stones.

Low voltage lighting systems have been well known for a number of years and have been used for decorations of buildings, illumination of steps, and the like. In such installations the lighting system is installed and secured within the structures after the structures have been built. One such system is shown in U.S. Pat. No. 4,143,411 issued Mar. 6, 1979. In this system, which is primarily designed for illuminating stairways, the lighting system is permanently secured within an area beneath the overhanging edge of each step, with the steps specifically constructed so as to accommodate the lighting apparatus. As will be obvious, this particular apparatus is quite labor intensive in that it is designed solely for installations in buildings and the like after the structure is completed.

The present invention is not directed to permanent lighting installations within buildings, but is directed to a unique means for lighting stepping stones which are used primarily around the exterior buildings or within interior gardens, landscapes and the like. These stones are normally set within the ground area.

Further, the stepping stones are manufactured such that the low voltage lighting elements are placed within the stones after they are manufactured and are easily removable for repair or replacement.

SUMMARY OF THE INVENTION

The present invention provides a low voltage lighting system which comprises at least one stepping stone, and preferably a series of stepping stones, with each stepping stone having at least one recessed channel in the upper face thereof and a removable light source inserted within the recessed channel with the light source comprising a flexible, substantially transparent tube and low voltage lights within the tube. The invention also includes means for connecting the light source to a power source in a selective or predetermined manner.

DETAILED DESCRIPTION OF THE INVENTION

Figure 1:
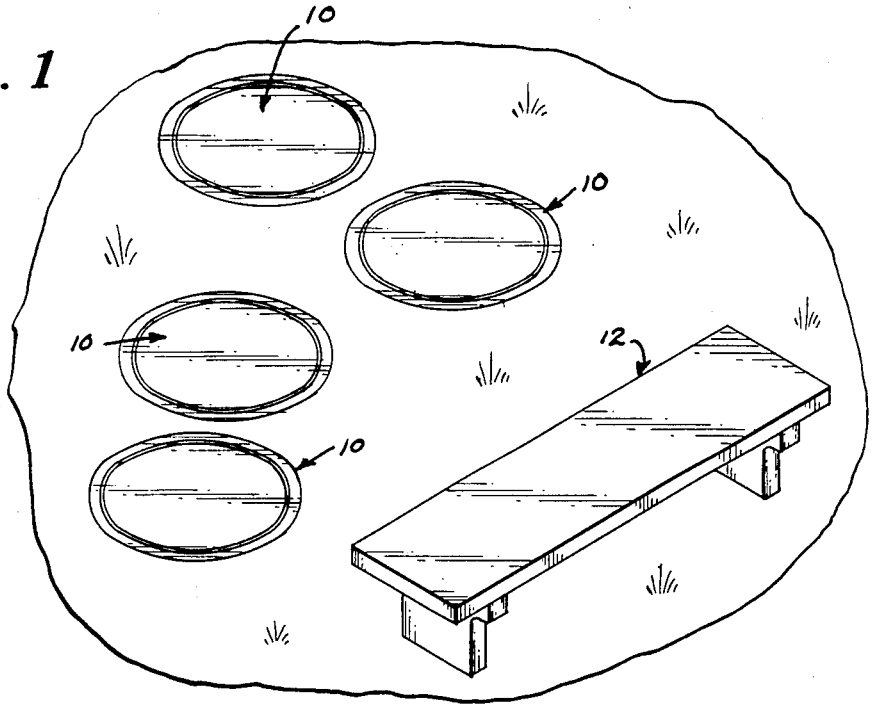
FIG. 1 is a perspective view of a typical outdoor setting employing the illuminated stepping stones of the present invention.

It should be noted that in the following description like items are given like numbers in the drawings.

It is further noted that the term "stepping stone" is used in a generic sense in that it can be constructed of any material which is sufficiently rigid to act as a stepping stone. Such materials include formed concrete, plastic, fiberglass, wood, and certain metals.

Turning now to FIG. 1, there is illustrated a typical installation wherein stones of the present invention are used. A grass area is depicted wherein a plurality of stepping stones 10 are randomly placed in a park-like area which is depicted as having a bench 12. As can be seen from FIG. 1, not only is illumination provided, but an aesthetically pleasant landscape area results from the use of the stepping stones.

Figure 2:
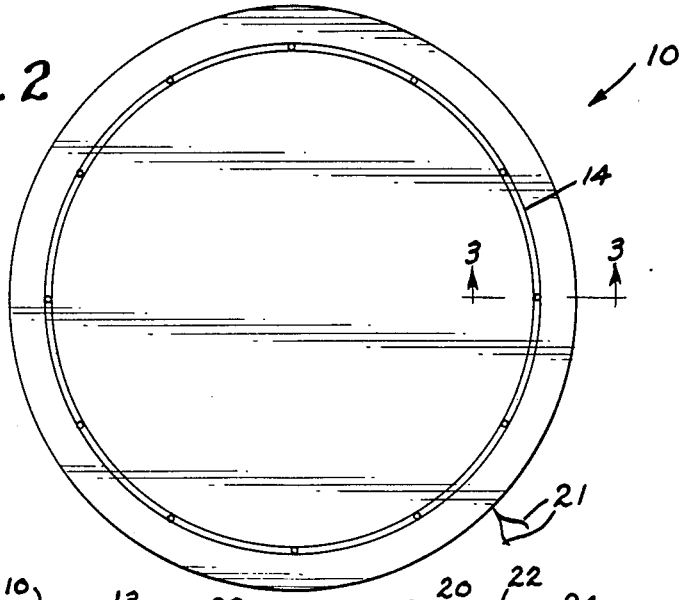
FIG. 2 is a plan view of one embodiment of a stepping stone made in accordance with the present invention.

FIG. 2 is a plan view of one embodiment of a stepping stone which may be used with the present invention. In this particular configuration, a single stepping stone 10 includes recessed channel 14 with the illuminating lights 20 being placed therein, as will be described in further detail. Power for these lights is provided through electrical leads 21.

Figure 3:
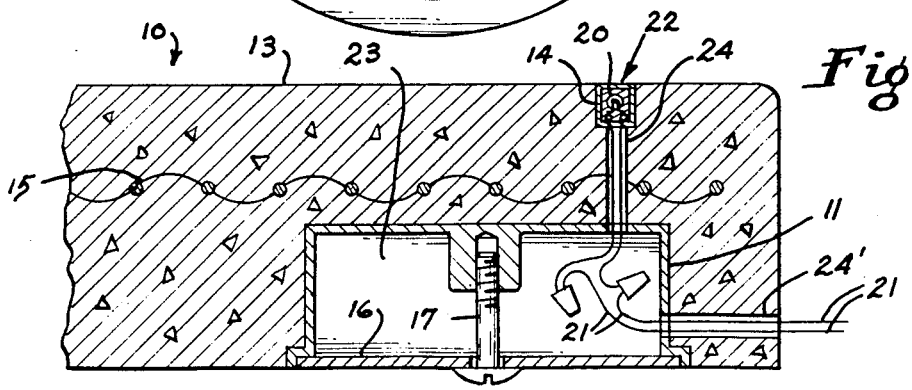
FIG. 3 is a partial cross-sectional view taken along the lines 3—3 of FIG. 2.

FIG. 3 is a partial sectional view taken along lines 3—3 of FIG. 2 and indicates that this particular stepping stone 10 is of pre-formed concrete having upper face 13 and wire mesh/rebar 15. Channel 14 is formed within the stepping stone and contains light source 20. As illustrated, this light includes a substantially transparent flexible tubular member 22 which, in the illustrated embodiment, contains a filling material which is also substantially transparent. This assures that the lights will not be subject to any moisture within the tubes and also holds them substantially in place. As can be seen, tubular member 22 is supported on substantially three sides thereof by channel 14 so that the illumination passes through the upper exposed face of tubular member 22. Tubular member 22 is of a size so as to snap into channel 14 and be easily retained therein in such a fashion that it is still removable for replacement and/or repair.

Also illustrated in FIG. 3 is an electrical junction box 11 which is inserted into the formed cavity 23. Bore holes 24 and 24' pass through stone 10 into cavity 23 so that electrical leads 21 may pass therethrough and terminate in Junction Box 11. After proper electrical connections are complete, cover 16 is secured with machine screw 17. For wet locations the bore holes 24 can be sealed with any potting compound. This will ensure a watertight fitting.

Figure 4:
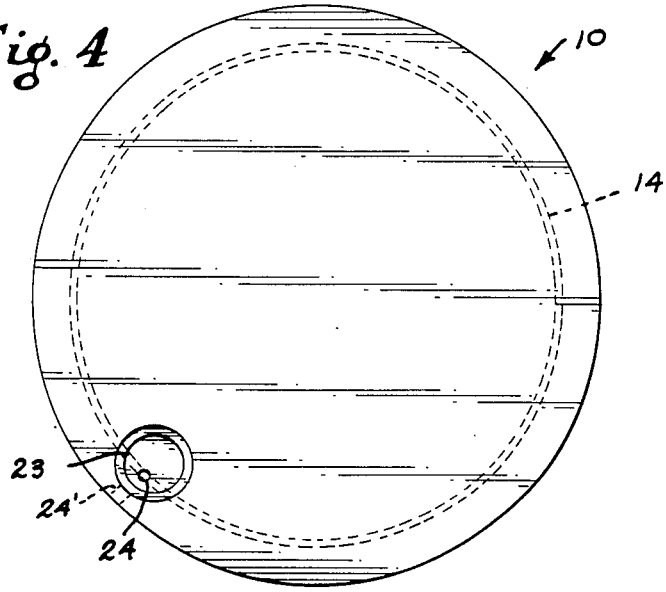
FIG. 4 is a bottom view of the stone of FIG. 2 illustrating the cavity location for the electrical outlet box.

FIG. 4 is a bottom view illustrating bore holes 24 and 24' which pass through stone 10 into the cavity 23 containing junction box 11.

Figure 5:
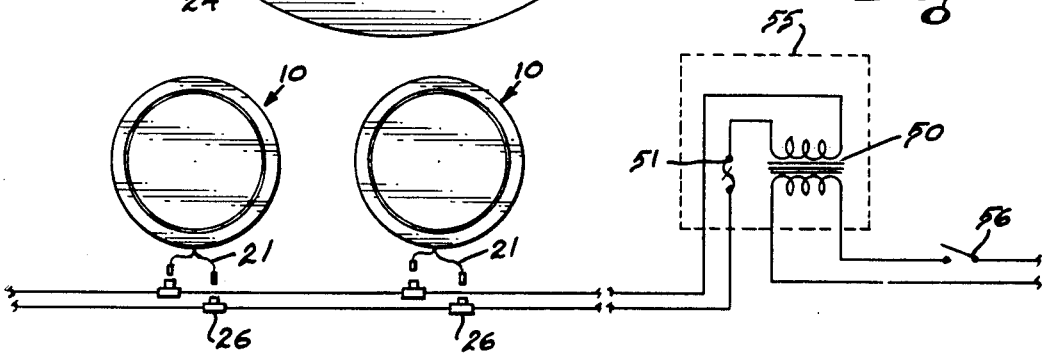
FIG. 5 is a schematic illustration of a wiring system for use with multiple installation of the stones of the present invention.

FIG. 5 is an illustration of a basic schematic electrical connection for the stones. Leads 21 from the stones are adapted to be mated with electrical connectors 26 which, in turn, are electrically connected to cables leading through fuse 51 to transformer 50. The transformer is in an enclosed box 55 and has leads extending therefrom for connection to a 120-volt house current source through switch 56. This transformer steps down the voltage so as to supply a low voltage source to the lighting system and, therefore, reduce hazards while still supplying a pleasant illumination of the stepping stones.

Figure 6:
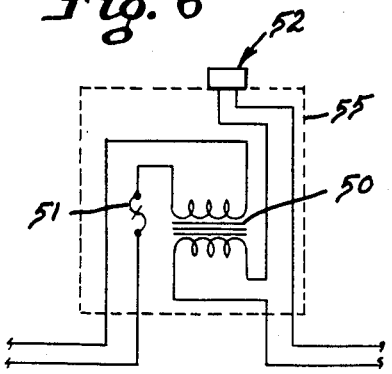
FIG. 6 is a schematic diagram of one means for connecting the lights to a power source.

FIG. 6 discloses a further schematic similar to FIG. 5 except that photocell switch 52 is interposed between the house current source and the transformer. This provides a means for lighting the stones at dusk and leaving them lit until dawn.

Figure 7:
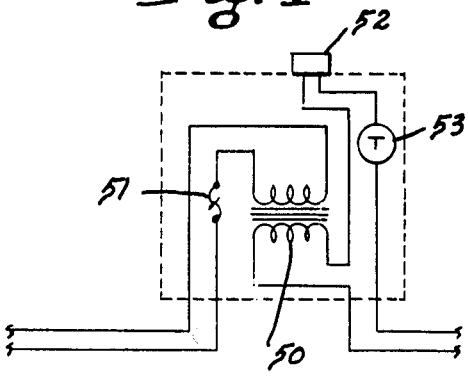
FIG. 7 is another embodiment of the wiring diagram of FIG. 6.

If preferred, FIG. 7 shows a further configuration wherein a timer switch 53 is interposed in the circuitry so that the particular time desired for lighting the stones can be selected.

Turning now to FIGS. 8–20, there are illustrated various forms which the stepping stones may take depending upon the area in which they are used and the particular design configuration which is desired.

Figure 8:
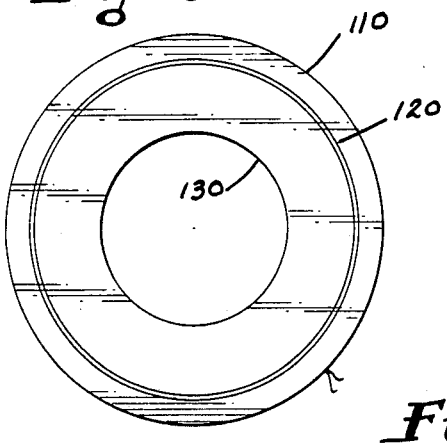
FIGS. 8–20 are plan views of various geometric configurations which may be used as stepping stones in the present invention.

FIG. 8 shows a circular stone 110 having lights 120 about the outer periphery of the face of the stone and includes a circular opening 130 within the center of the stone.

Figure 9:
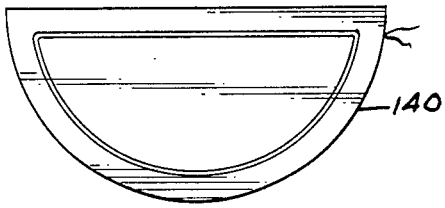

FIG. 9 shows a half-circle stone 140 having the lights placed adjacent to the periphery of the upper face.

Figure 10:
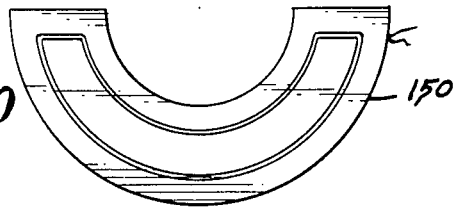

FIG. 10 discloses an arcurate 180-degree stone 150 which also has the lighting substantially adjacent to the periphery of the stone in the configuration as illustrated.

Figure 11:
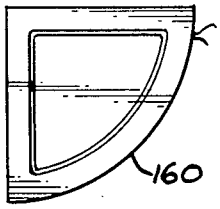

FIG. 11 shows a quadrature stone 160 which again includes the lighting as previously described.

Figure 12:
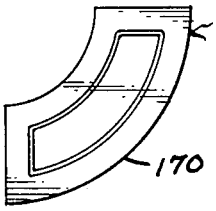

FIG. 12 discloses a sectional arcurate configuration 170 with the lighting adjacent to the outer perimeter.

Figure 13:
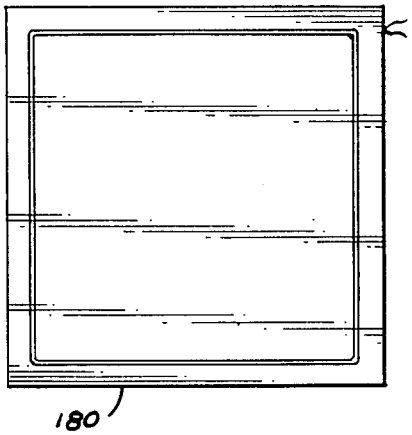
Figure 14:
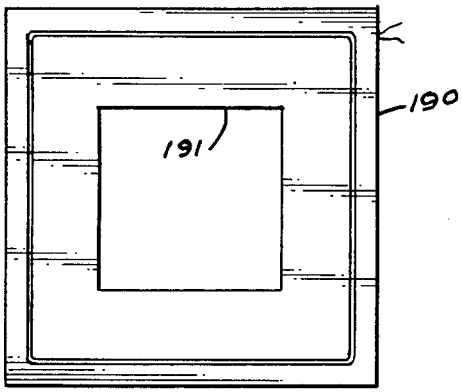

FIGS. 13 and 14 disclose substantially square stepping stones 180 and 190 with the lighting therein, with FIG. 14 having a central opening 191.

Figure 15:
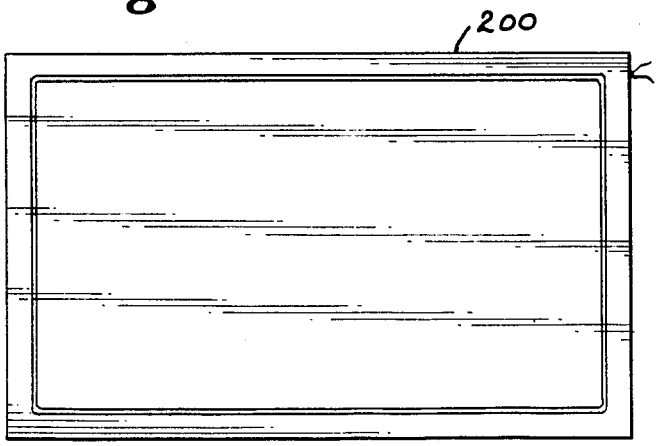
Figure 16:
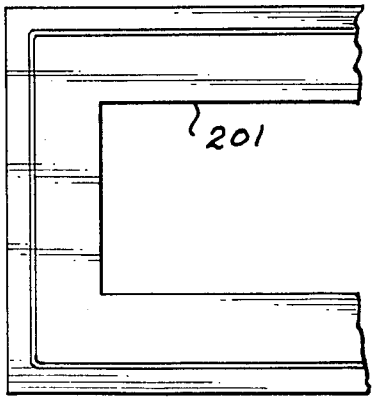

FIG. 15 discloses a rectangular configuration 200 having the lights about the periphery of the upper face while FIG. 16 shows a partial view of a similar rectangular configuration having an opening 201 centrally located in the rectangular stone.

Figure 17:
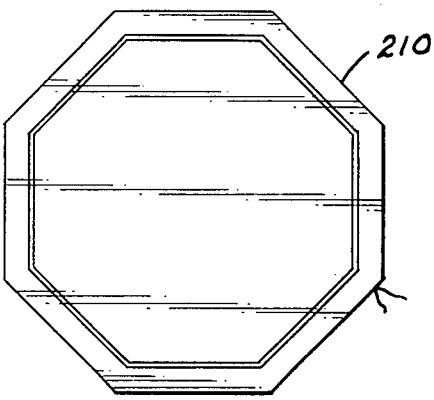
Figure 18:
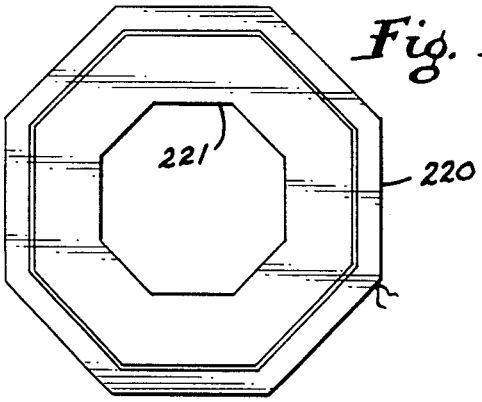

FIGS. 17 and 18 disclose octagonal stones 210 and 220 with FIG. 18 having a central octagonal opening (221) therein.

Figure 19:
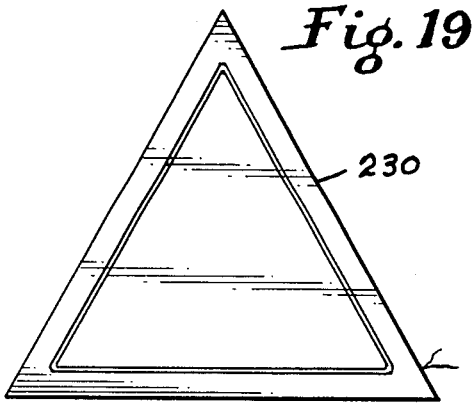
Figure 20:
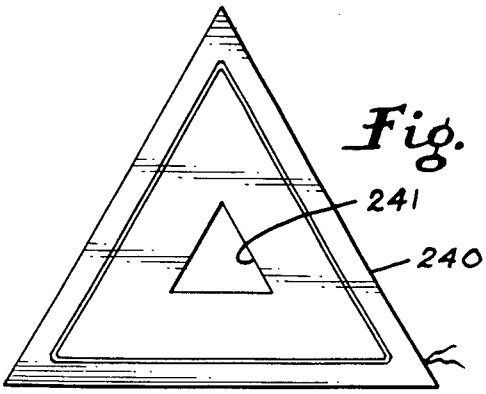

Similarly, FIGS. 19 and 20 disclose triangular-shaped stepping stones 230 and 240, with FIG. 20 showing a stone with a similar triangularly-shaped central hole there through.

FIGS. 8–20 include the lead lines extending outwardly from the stepping stone. The preferred installation requires that the stepping stones be set into the ground at such a level that the light tubing is clearly seen, but also at such a level that the lead wires can be led out from the stepping stones and buried below the surface of the ground, with the ultimate lead wires extending to the transformer. Obviously, all weatherproof connectors are used so that there will be no problems relative to moisture in the lead wires.

It is to be understood that the above description and drawings are illustrative only since it is quite obvious that the stepping stones could take any desired form and various grooved configurations could be used to meet any aesthetic desires. Accordingly, the invention is to be limited only by the scope of the following claims.

I claim:

1. A low voltage light system comprising
at least one stepping-stone;
at least one recessed groove in the upper face of said stepping stone;
a light source removably inserted within said recessed groove, said light source comprising
a flexible, substantially transparent tube;
a low voltage light source within said tube; and
electrical leads extending from said light source, through said stepping stone and exiting therefrom, for connecting said light source to an external power source.

2. The lighting system of claim 1 wherein said recessed groove extends substantially adjacent to the outer periphery of said stepping stone.

3. The lighting system of claim 2 wherein said stepping-stone is substantially circular.

4. The lighting system of claim 2 wherein said stepping-stone is substantially rectangular.

5. The lighting system of claim 2 wherein said stepping-stone is substantially semi-circular.

6. The lighting system of claim 2 wherein said stepping-stone is a quadrant of a circle.

7. The lighting system of claim 2 wherein said stepping-stone is multisided.

8. The lighting system of claim 2 wherein said stepping-stone is arcuate.

9. The stepping-stone of claim 2 further comprising an opening in said stone interior of said light source.

10. The lighting system of claim 1 where said power source connecting means comprises a manual switch.

11. The lighting system of claim 1 wherein said power source connecting means comprises a photocell switch.

12. The lighting system of claim 1 wherein said power source connecting means comprises a timer switch.

13. A low voltage light system comprising
at least one stepping-stone;
at least one recessed groove in the upper face of said stepping stone;
a light source removably inserted within said recessed groove, said light source comprising
a flexible, substantially transparent tube;
a low voltage light source within said tube;
a recessed cavity in the lower face of said stepping stone;
at least one borehole interconnecting said recessed groove and said cavity; and
means for connecting said light source to a power source.

14. The light system of claim 13 further comprising
an electrical junction box in said cavity; and
a borehole between said junction box and the side of said stepping stone.

15. The light system of claim 14 further comprising
a cover for said junction box, said cover being substantially planar with said lower face of said stepping stone; and
means for removably securing said cover to said junction box.

* * * * *